US009764189B2

(12) United States Patent
Jensen

(10) Patent No.: US 9,764,189 B2
(45) Date of Patent: Sep. 19, 2017

(54) HANDHELD EXERCISE APPARATUS

(71) Applicant: Gunnar Jensen, Las Vegas, NV (US)

(72) Inventor: Gunnar Jensen, Las Vegas, NV (US)

( * ) Notice: Subject to any disclaimer, the term of this patent is extended or adjusted under 35 U.S.C. 154(b) by 0 days.

(21) Appl. No.: 15/080,200

(22) Filed: Mar. 24, 2016

(65) Prior Publication Data

US 2017/0021222 A1 Jan. 26, 2017

Related U.S. Application Data

(60) Provisional application No. 62/137,315, filed on Mar. 24, 2015.

(51) Int. Cl.

| | |
|---|---|
| ***A63B 21/06*** | (2006.01) |
| ***A63B 23/02*** | (2006.01) |
| ***A63B 21/00*** | (2006.01) |
| ***A63B 23/035*** | (2006.01) |

(Continued)

(52) U.S. Cl.

CPC ..... *A63B 23/0233* (2013.01); *A63B 21/0618* (2013.01); *A63B 21/4035* (2015.10);

(Continued)

(58) Field of Classification Search

CPC ..... A63B 21/0004; A63B 21/00058; A63B 21/00061; A63B 21/00065; A63B 21/00069; A63B 21/00072; A63B 21/00185; A63B 21/06; A63B 21/0615; A63B 21/0616; A63B 21/0617; A63B 21/0618; A63B 21/072; A63B 21/0724; A63B 21/0728; A63B 21/075; A63B 21/08; A63B 21/15; A63B 21/159; A63B 21/16; A63B 21/1681; A63B 21/169; A63B 21/4023; A63B 21/4027; A63B 21/4033; A63B 21/4035; A63B 21/4043; A63B 21/4045; A63B 21/4047; A63B 21/4049; A63B 23/0205; A63B 23/0211; A63B 23/0238; A63B 23/035; A63B 23/03508; A63B 23/03516; A63B 23/12;

(Continued)

(56) References Cited

U.S. PATENT DOCUMENTS 3,796,431 A * 3/1974 Sinyard ..... A63B 21/0618 482/108
5,586,778 A * 12/1996 Lindh ..... B62B 1/047 280/40

(Continued)

*Primary Examiner* — Sundhara Ganesan
*Assistant Examiner* — Gary D Urbiel Goldner
(74) *Attorney, Agent, or Firm* — Ruth Eure

(57) ABSTRACT

A handheld exercise apparatus for achieving an optimal workout for various parts of an upper body of a user including abdominal, chest, back, and arm muscles is provided. The handheld exercise apparatus comprises an elongated handle having a first end and a second end. An axle component is mounted to the second end of the elongated handle. A substantially V-shaped housing frame extends from the axle with the housing frame having a first arm and a second arm. A primary weight is positioned between the first arm and the second arm of the housing frame. A roller ball mechanism is mounted to the primary weight with the roller ball mechanism rollable along a surface. The roller ball mechanism allows the handheld exercise apparatus to move in a generally side to side motion for optimal resistance.

20 Claims, 4 Drawing Sheets

Fig. 1

(51) Int. Cl.
*A63B 23/12* (2006.01)
*A63B 21/072* (2006.01)
*A63B 22/20* (2006.01)

(52) U.S. Cl.
CPC .. *A63B 23/03508* (2013.01); *A63B 21/00061* (2013.01); *A63B 21/072* (2013.01); *A63B 22/20* (2013.01); *A63B 23/0205* (2013.01); *A63B 23/0211* (2013.01); *A63B 23/0238* (2013.01); *A63B 23/1209* (2013.01); *A63B 23/1281* (2013.01); *A63B 2208/0204* (2013.01); *A63B 2208/0233* (2013.01); *A63B 2210/50* (2013.01); *A63B 2225/09* (2013.01); *A63B 2225/093* (2013.01)

(58) Field of Classification Search
CPC ..... A63B 23/1209; A63B 23/1218; A63B 23/1245; A63B 23/1281; A63B 69/0057; A63B 69/0059; A63B 69/06; A63B 2069/0062; A63B 2069/064; A63B 2069/066; A63B 2208/0204; A63B 2208/0228; A63B 2208/0233; A63B 2210/50; A63B 2225/09; A63B 2225/093
See application file for complete search history.

(56) References Cited

U.S. PATENT DOCUMENTS

| | | | | |
|---|---|---|---|---|
| 6,241,643 | B1 * | 6/2001 | Loft | A63B 21/015 482/114 |
| 6,302,811 | B1 * | 10/2001 | Topham | A63B 63/083 248/280.11 |
| 2006/0194653 | A1 * | 8/2006 | Nye | A63B 63/083 473/479 |
| 2012/0309599 | A1 * | 12/2012 | Miller, Jr. | A63B 22/20 482/139 |
| 2013/0123078 | A1 * | 5/2013 | Marji | A61H 15/00 482/139 |
| 2013/0324376 | A1 * | 12/2013 | Colby | A63B 21/008 482/112 |
| 2014/0179498 | A1 * | 6/2014 | Lalaoua | A63B 21/02 482/131 |
| 2016/0038780 | A1 * | 2/2016 | Hugou | A47C 3/029 482/8 |
| 2016/0089557 | A1 * | 3/2016 | Mayfield | A63B 21/025 482/8 |

* cited by examiner

HANDHELD EXERCISE APPARATUS

CLAIM OF PRIORITY

This patent application claims priority under 35 USC 119(e)(1) from U.S. Provisional Patent Application Ser. No. 62/137,315 filed Mar. 24, 2015, of common inventorship herewith entitled, "Roller Weights," which is incorporated herein by reference as though the same were set forth in its entirety.

FIELD OF THE INVENTION

The present invention pertains to the field of health and fitness, and more specifically to the field of exercise equipment.

BACKGROUND OF THE INVENTION

Being physically active is one of the most effective tools in increasing one's health of mind, body and spirit. Reducing risk of heart disease and stroke, physical activity also helps to lower or control other risk factors such as high blood pressure, high blood cholesterol, excess body weight and diabetes. A regular exercise regimen helps an individual look and feel better, become stronger and more flexible, possess more energy, and reduce stress and tension. Aware of physical and mental benefits afforded by regular exercise, many people wishing to engage in an exercise endeavor encounter daunting obstacles. With demands of work, school and family in today's fast paced world, little time remains in a day to set aside twenty to thirty minutes for walking on a treadmill, doing reps with free weights, or strolling around a neighborhood after dinner. Trips to the local gym every other day are impractical for most busy people and also costly for those individuals on tight budgets.

People with limited physical capabilities also need and want to keep up their strength, muscle tone and energy. These individuals often are frustrated by a lack of exercise equipment or activities that allow them to work on their bodies in a pain free and comfortable manner. Unable to lift even light weights or to walk for long distances, these individuals usually opt for avoiding workouts altogether and doing nothing.

The prior art has put forth several designs for exercise equipment. Among these are:

US Patent 2013/0123078 to Sammy Black Marji describes a double roller exercise device with a pair of elongated, spaced apart rollers with a grip handle secured at the end of each roller. A compressible and expandable spring is connected to the adjacent grip handle. The roller can be pushed or pulled by the exerciser by manipulating the grip handles. This exercise device is configured for exercising hand's, wrists and pectoral parts of the body. The device is also useful for massaging the back, legs and thighs of the exerciser.

US Patent 2012/0309599 to Gary Edward Miller, Jr. describes a rolling exercise device comprising an elongate member that has a first handle assembly secured to its first end and a second handle assembly secured to its second end. The handle assemblies include a base that is rotatably secured to a handle support structure. The handle assemblies also include a handle for gripping. The handle assemblies further function as wheels on each side of the elongate member, which allows the exercise device to roll. In addition, the handle assemblies are removable from the ends of the elongate member and mutually joinable in a second configuration that excludes the elongate member. The second configuration can be rolled along a surface by a user gripping the handles and applying a force that causes the base of each handle assembly to rotate.

U.S. Pat. No. 3,796,431 to J Sinyard describes an exercising device which contains spherically shaped weights which are rotatable, allowing the device to be used by rolling the device along a surface such as a floor or wall in addition to lifting in the conventional manner.

None of these prior art references describe the present invention.

SUMMARY OF THE INVENTION

It is an object of the present invention to provide a handheld exercise apparatus configured to assist in achieving an optimal workout for various parts of the upper body including abdominal, chest, back and arm muscles.

The present invention is a handheld exercise apparatus for achieving an optimal workout for various parts of the upper body including abdominal, chest, back, and arm muscles. The handheld exercise apparatus comprises an elongated handle having a first end and a second end. An axle component is mounted to the second end of the elongated handle. A substantially V-shaped housing frame extends from the axle with the housing frame having a first arm and a second arm. A primary weight is positioned between the first arm and the second arm of the housing frame. A roller ball mechanism mounted to the primary weight with the roller ball mechanism rollable along a surface. The roller ball mechanism allows the handheld exercise apparatus to move in a generally side to side motion for optimal resistance.

In addition, the present invention includes a method for achieving an optimal workout for various parts of the upper body including abdominal, chest, back, and arm muscles. The method comprises providing an elongated handle having a first end and a second end, mounting an axle component to the second end of the elongated handle, extending a substantially V-shaped housing frame from the axle with the housing frame having a first arm and a second arm, positioning a primary weight between the first arm and the second arm of the housing frame, mounting a roller ball mechanism to the primary weight, rolling the roller ball mechanism along a surface, and allowing the handheld exercise apparatus to move in a generally side to side motion for optimal resistance.

The present invention further includes a handheld exercise apparatus for achieving an optimal workout for various parts of the upper body including abdominal, chest, back, and arm muscles. The handheld exercise apparatus comprises an elongated handle having a first end and a second end. An axle component is mounted to the second end of the elongated handle. A substantially V-shaped housing frame extends from the axle with the housing frame having a first arm and a second arm. A primary weight is positioned between the first arm and the second arm of the housing frame. At least one secondary weight positioned between the primary weight and the axle component. A roller ball mechanism is mounted to the primary weight with the roller ball mechanism positioned in the approximate center of the primary weight and rollable along a surface. The roller ball mechanism allows the handheld exercise apparatus to move in a generally side to side motion for optimal resistance.

DETAILED DESCRIPTION OF THE INVENTION

Figure 2:
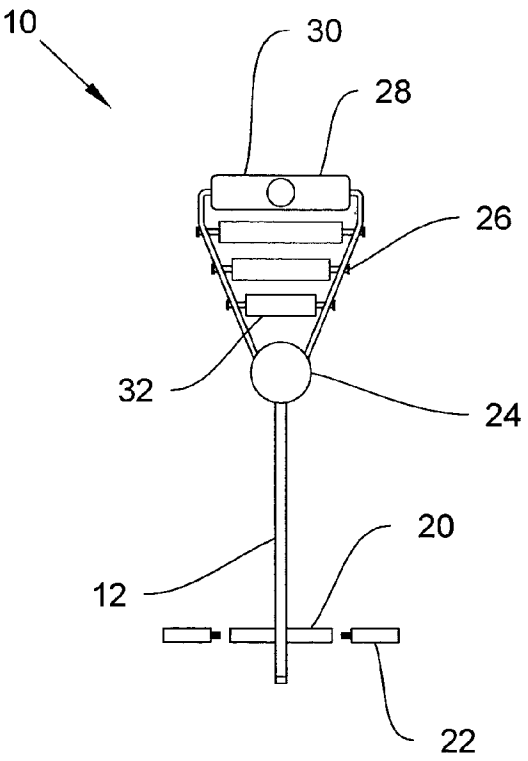
FIG. 2 is an elevational front view illustrating the handheld exercise apparatus, constructed in accordance with the present invention, showing an integrated roller ball mechanism, to facilitate side to side motion, and screw on extension handles.
Figure 1:
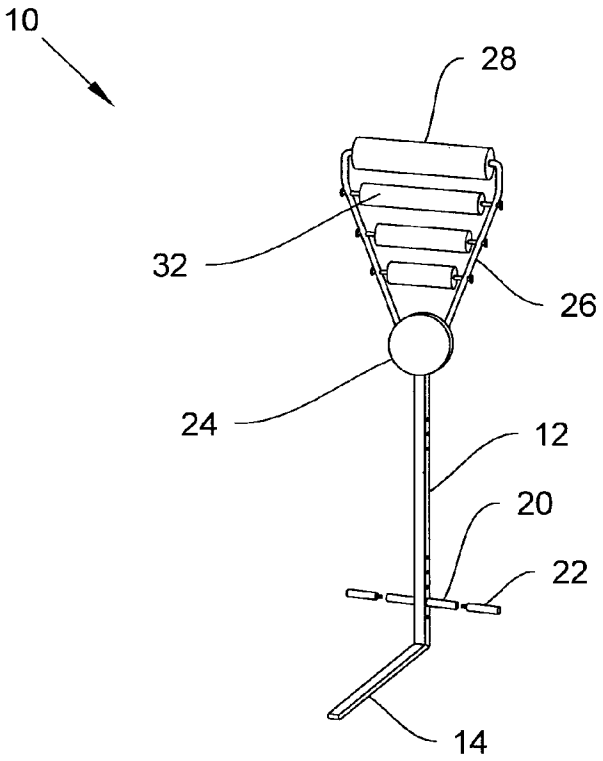
FIG. 1 is a perspective view illustrating an handheld exercise apparatus, constructed in accordance with the present invention, showing a main weight, a snap weight, an axle component for positioning the handle on a wall or floor surface, extension handles and a floor extension bar to support the device thus allowing the user to release the handles alleviating additional strain caused by putting the device on the floor.
Figure 4:
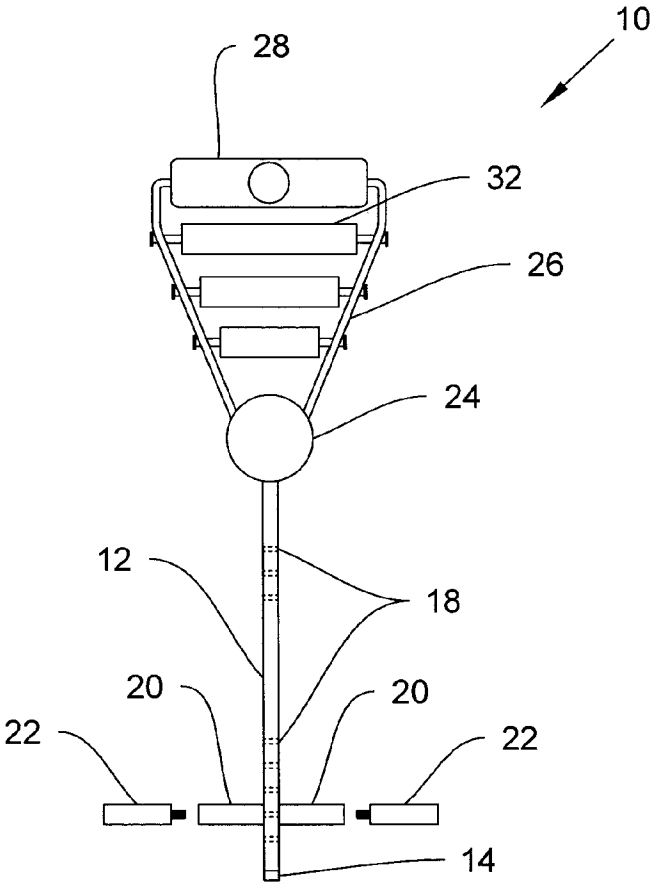
FIG. 4 is another elevational front view illustrating the handheld exercise apparatus, constructed in accordance with the present invention.
Figure 3:
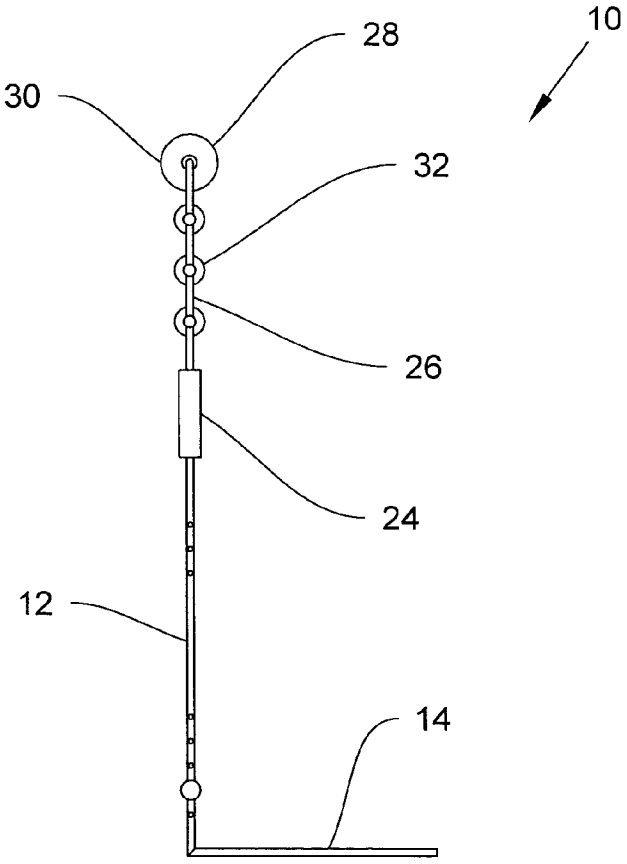
FIG. 3 is an elevational side view illustrating the handheld exercise apparatus, constructed in accordance with the present invention, showing an integrated roller ball mechanism on the backside of the primary weight, a detached extension position, and approximately four long handle extension positions.
Figure 6:
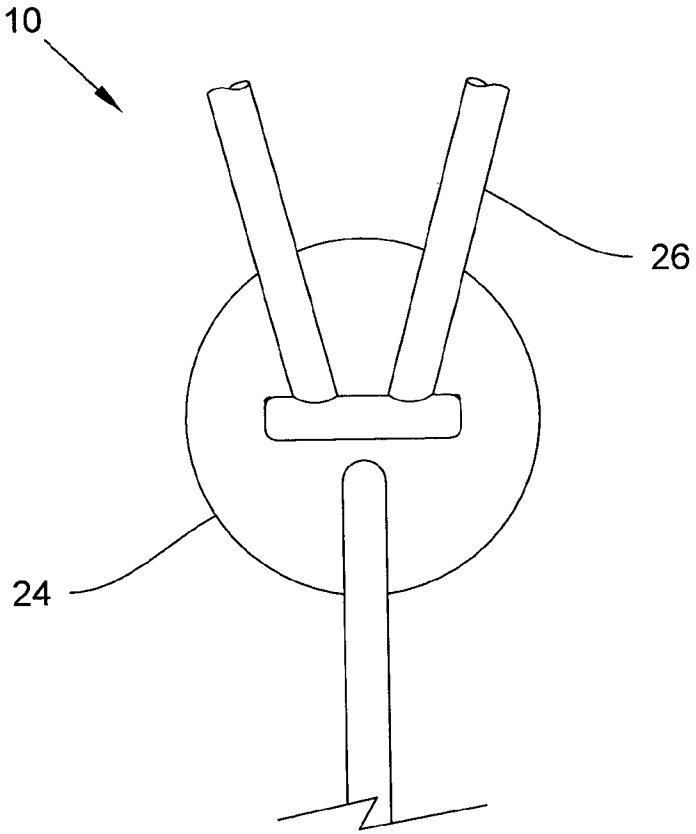
FIG. 6 is an elevational rear view illustrating the axle component of the handheld exercise apparatus, constructed in accordance with the present invention.
Figure 5:
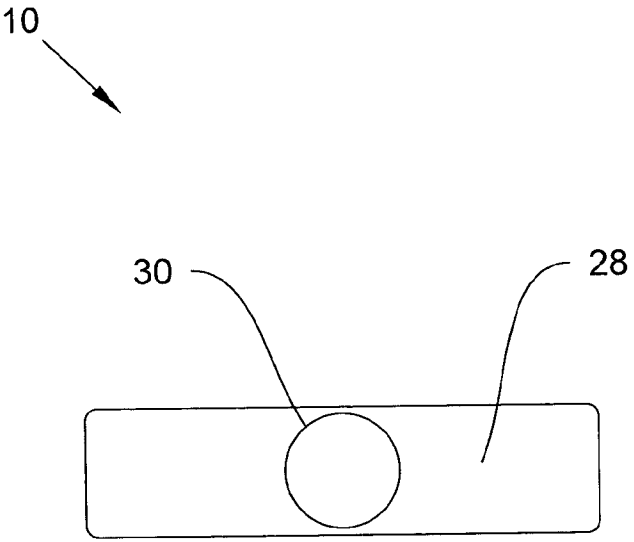
FIG. 5 is an elevational rear view illustrating the primary weight illustrating the handheld exercise apparatus, constructed in accordance with the present invention, showing the integrated roller ball mechanism on the backside of the primary weight.
Figure 9:
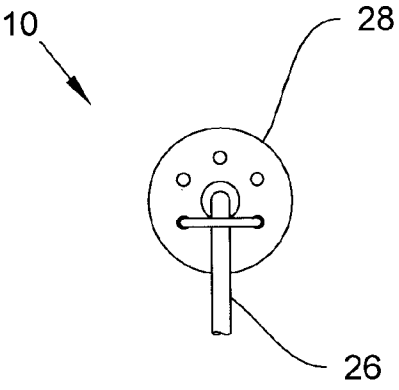
FIG. 9 is an elevational side view illustrating the primary weight of the handheld exercise apparatus, constructed in accordance with the present invention, showing pins inserted into the primary weight to inhibit vertical movement of the primary weight during horizontal movement of the apparatus.
Figure 8:
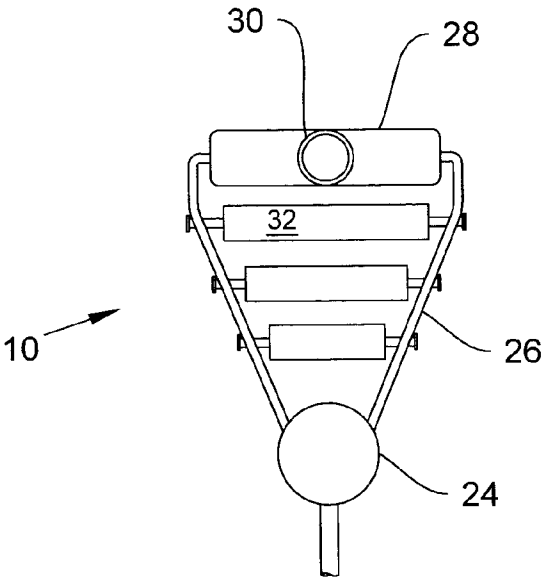
FIG. 8 is an elevational rear view illustrating the handheld exercise apparatus, constructed in accordance with the present invention, showing the integrated roller ball mechanism on the backside of the primary weight.
Figure 7:
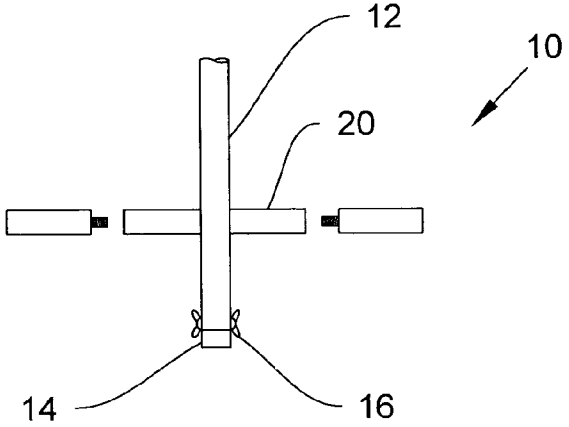
FIG. 7 is an elevational front view illustrating the elongated handle of the handheld exercise apparatus, constructed in accordance with the present invention, showing the stationary handles and the swivel handles.

The present invention, hereinafter referred to as a Handheld Exercise Apparatus, indicated generally at 10, is an exercise apparatus configured to assist in achieving an optimal workout for various parts of the upper body including abdominal, chest, back and arm muscles. The Handheld Exercise Apparatus 10 is essentially a handheld device configured to hold added weights as well as a wheel component. The Handheld Exercise Apparatus 10 allows a user to exercise from a seated position using the floor as a support surface or the user can stand next to a wall using the wall as a support surface.

The Handheld Exercise Apparatus 10 of the present invention includes an elongated handle 12 having a first end and a second end. The elongated handle 12 can include a number of adjustable sections and additions to accommodate a user's stature as well as to facilitate usage of the present invention on a floor or wall. In an embodiment of the present invention, the elongated handle 12 includes an extension bar 14 secured to the first end of the elongated handle 12 to increase the length of the elongated handle 12. In a preferred embodiment, butterfly screws 16 can be used for securing the extension bar 14 to the elongated handle 12. Furthermore, the extension bar 14 can be removably mounted to the first end of the elongated handle 12 which flips up and down and locks in place for positioning the Handheld Exercise Apparatus 10 on the floor.

The elongated handle 12 of the Handheld Exercise Apparatus 10 of the present invention includes a plurality of threaded apertures 18 positioned on opposite sides of the elongated handle 12, extending the length of the elongated handle 12. A pair of stationary handles 20 are threadably secured to the opposite threaded apertures 18 for a user to grasp during use of the Handheld Exercise Apparatus 10. In an embodiment, a pair of swivel handles 22 can be secured to the stationary handles 20 extending the length of the stationary handles 20 and for better performance.

In a preferred embodiment of the Handheld Exercise Apparatus 10 of the present invention, the elongated handle 12 includes four threaded apertures 18 formed nearingly adjacent the first end of the elongated handle 12 and three threaded apertures formed nearingly adjacent the second end of the elongated handle 12. The apertures 18 formed near the first end of the elongated handle 12 allow the user to adjust the length of the handle and use the Handheld Exercise Apparatus 10 in long handle positions, and the apertures 18 formed near the second end of the elongated handle 12 allow the user to use the Handheld Exercise Apparatus 10 in a short handle position.

An axle component 24 is mounted to the second end of the elongated handle 12 of the Handheld Exercise Apparatus 10 of the present invention. The axle component 24 allows the housing frame 26 to be positioned according to the surface on which it is used, i.e., either the wall or the floor.

In addition, the Handheld Exercise Apparatus 10 of the present invention has a housing frame 26 extending from the axle component 24. The housing frame 26 is substantially V-shaped having a first arm and a second arm. A primary weight 28 is positioned between distal ends of the first arm and the second arm of the housing frame 26. In a preferred embodiment, the primary weight 28 can be any desired weight but preferably weights approximately fifteen (15 lbs.) pounds to approximately twenty (20 lbs.) pounds.

In the approximate center of the primary weight 28 of the Handheld Exercise Apparatus 10 of the present invention is a roller ball mechanism 30. The roller ball mechanism 30 allows the Handheld Exercise Apparatus 10 to move in a generally side to side motion for optimal resistance. Further detail concerning the use of the Handheld Exercise Apparatus 10 will be described in further detail below.

Extending downward from the location of the primary weight 28 of the Handheld Exercise Apparatus 10 of the present invention, a plurality of snap fittings are provided between the first arm and the second arm of the housing frame 26 for attaching additional weights 32 in increments of approximately five, ten, and fifteen pounds. In a preferred embodiment, the first additional weight 32 weighs between approximately ten (10 lbs.) pounds to fifteen (15 lbs.) pounds, the second additional weight 32 weighs between approximately five (5 lbs.) pounds to ten (10 lbs.) pounds, and the third additional weight 32 weights between approximately three (3 lbs.) pounds to five (5 lbs.) pounds.

Simple in construction yet extremely effective in application, use of the Handheld Exercise Apparatus 10 is easy and straightforward. A user chooses a particular position and type of weight exercise. One user may wish to sit in a chair. Conversely, another user may want to plant their back against the wall. The seated user extends the Handheld Exercise Apparatus 10 in front of their body, angling it so the distal end is flush with the floor surface. The user then moves the Handheld Exercise Apparatus 10 in a rowing motion and continues until reaching an allotted amount of time or repetitions. The standing user positions the distal end of the Handheld Exercise Apparatus 10 above their head and against the wall. The user then moves the Handheld Exercise Apparatus 10 in a series of repetitions, simulating a curling motion. Again, the user continues the curling motion until reaching an allotted amount of time or repetitions. Using the Handheld Exercise Apparatus 10, the user tones the muscles in the aforementioned areas of the body while comfortably sitting in a chair or standing upright.

The Handheld Exercise Apparatus 10 of the present invention provides exercisers with a simple, inexpensive, and non cumbersome means of engaging in physical activity in the comfort of their homes. The present invention enables an individual to enjoy the benefits of an exercise regimen without undue strain on their knees, legs, back, and arms. Using the Handheld Exercise Apparatus 10 eliminates a need for other workout regimens and trips to the gym that take up valuable time and money. The side to side resistance motion provided by the Handheld Exercise Apparatus 10 accentuates an upper body workout commonly provided by standard free weights while more effectively targeting upper body muscles, without undue strain on one's wrists and joints. In this manner, users may comfortably roll themselves into a more ripped physique.

Multifunctional, the Handheld Exercise Apparatus 10 of the present invention ensures proper working of muscle mass while also providing cardio fitness. Comprised of minimal components, the Handheld Exercise Apparatus 10 is stored away easily. While the Handheld Exercise Apparatus 10 was conceived primarily for household users, but also is an invaluable tool for physical therapists. They can utilize the Handheld Exercise Apparatus 10 in therapy sessions and recommend the Handheld Exercise Apparatus 10 exercise regimen to their patients. The Handheld Exercise Apparatus 10 can return physical activity to those individuals who normally have little time or ability to engage in exercise. Durably constructed of high quality materials, the present invention is effectively usable by adults of all ages and physical abilities.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claim.

The invention claimed is:

1. A handheld exercise apparatus for achieving an optimal workout for various parts of an upper body of a user including abdominal, chest, back, and arm muscles, the handheld exercise apparatus comprising:

an elongated handle having a first end and a second end;

an axle component mounted to the second end of the elongated handle;

a substantially V-shaped housing frame extending from the axle, the housing frame having a first arm and a second arm;

a primary weight positioned between the first arm and the second arm of the housing frame; and a roller ball mechanism mounted to the primary weight, the roller ball mechanism rollable along a surface;

wherein the roller ball mechanism allows the handheld exercise apparatus to move in a generally side to side motion for optimal resistance.

2. The handheld exercise apparatus of claim 1 wherein the elongated handle includes a plurality sections.

3. The handheld exercise apparatus of claim 1 wherein the elongated handle includes an extension bar secured to the first end of the elongated handle.

4. The handheld exercise apparatus of claim 3 wherein the extension bar is secured to the elongated handle by butterfly screws.

5. The handheld exercise apparatus of claim 3 wherein the extension bar is pivotally secured to the first end of the elongated handle and releasably lockable in a desired position.

6. The handheld exercise apparatus of claim 1 and further comprising:

a plurality of threaded apertures positioned on opposite sides of the elongated handle, extending a length of the elongated handle.

7. The handheld exercise apparatus of claim 6 and further comprising:

a pair of stationary handles threadably secured to the oppositely positioned threaded apertures.

8. The handheld exercise apparatus of claim 7 and further comprising:

a pair of swivel handles releasably and respectively securable to the stationary handles.

9. The handheld exercise apparatus of claim 6 wherein the elongated handle includes four threaded apertures formed nearingly adjacent the first end of the elongated handle and three threaded apertures formed nearingly adjacent the second end of the elongated handle.

10. The handheld exercise apparatus of claim 1 wherein the roller ball mechanism is positioned in an approximate center of the primary weight.

11. The handheld exercise apparatus of claim 1 and further comprising:

at least one secondary weight positioned between the primary weight and the axle component.

12. The handheld exercise apparatus of claim 11 wherein the primary weight and the at least one secondary weight are secured between the first arm and the second arm of the housing frame by snap fittings.

13. A method for achieving an optimal workout for various parts of an upper body of a user including abdominal, chest, back, and arm muscles, the method comprising:

providing an elongated handle having a first end and a second end;

mounting an axle component to the second end of the elongated handle;

extending a substantially V-shaped housing frame from the axle, the housing frame having a first arm and a second arm;

positioning a primary weight between the first arm and the second arm of the housing frame;

mounting a roller ball mechanism to the primary weight;

rolling the roller ball mechanism along a surface; and allowing the handheld exercise apparatus to move in a generally side to side motion for optimal resistance.

14. A handheld exercise apparatus for achieving an optimal workout for various parts of an upper body of a user including abdominal, chest, back, and arm muscles, the handheld exercise apparatus comprising:

an elongated handle having a first end and a second end;

an axle component mounted to the second end of the elongated handle;

a substantially V-shaped housing frame extending from the axle, the housing frame having a first arm and a second arm;

a primary weight positioned between the first arm and the second arm of the housing frame;

at least one secondary weight positioned between the primary weight and the axle component;

a roller ball mechanism mounted to the primary weight, the roller ball mechanism positioned in an approximate center of the primary weight and rollable along a surface;

wherein the roller ball mechanism allows the handheld exercise apparatus to move in a generally side to side motion for optimal resistance.

15. The handheld exercise apparatus of claim 14 wherein the elongated handle includes a plurality sections.

16. The handheld exercise apparatus of claim 14 wherein the elongated handle includes an extension bar secured to the first end of the elongated handle.

17. The handheld exercise apparatus of claim 16 wherein the extension bar is pivotally secured to the first end of the elongated handle and releasably lockable in a desired position.

18. The handheld exercise apparatus of claim 14 and further comprising:

a plurality of threaded apertures positioned on opposite sides of the elongated handle, extending a length of the elongated handle.

19. The handheld exercise apparatus of claim 18 and further comprising:

a pair of stationary handles threadably secured to the oppositely positioned threaded apertures.

20. The handheld exercise apparatus of claim 19 and further comprising:

a pair of swivel handles releasably and respectively securable to the stationary handles.

* * * * *